US006815902B1

(12) United States Patent
Perrin et al.

(10) Patent No.: US 6,815,902 B1
(45) Date of Patent: Nov. 9, 2004

(54) FIELD EMISSION FLAT SCREEN WITH MODULATING ELECTRODE

(75) Inventors: Aimé Perrin, St Ismier (FR); Adeline Fournier, Mount Saint Martin (FR); Brigitte Montmayeul, Bernin (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 10/049,777

(22) PCT Filed: Sep. 8, 2000

(86) PCT No.: PCT/FR00/02487

§ 371 (c)(1),
(2), (4) Date: Jul. 22, 2002

(87) PCT Pub. No.: WO01/18838

PCT Pub. Date: Mar. 15, 2001

(30) Foreign Application Priority Data

Sep. 9, 1999 (FR) ..... 9911292
Feb. 15, 2000 (FR) ..... 0001832

(51) Int. Cl.[7] ..... G09G 3/10
(52) U.S. Cl. ..... 315/169.3; 315/169.4
(58) Field of Search ..... 315/169.3, 169.2, 315/169.1, 169.4; 313/497, 495; 345/75.2, 76

(56) References Cited

U.S. PATENT DOCUMENTS

| | | | | |
|---|---|---|---|---|
| 3,671,798 A | | 6/1972 | Lees | 313/336 |
| 5,252,833 A | * | 10/1993 | Kane et al. | 250/423 F |
| 5,374,868 A | | 12/1994 | Tjaden et al. | 313/310 |
| 5,382,185 A | | 1/1995 | Gray et al. | 445/49 |
| 5,578,091 A | * | 11/1996 | Jackson et al. | 44/399 |
| 5,610,471 A | | 3/1997 | Bandy et al. | 313/309 |
| 5,772,904 A | * | 6/1998 | Kim | 216/24 |
| 5,818,166 A | * | 10/1998 | Karpov et al. | 313/495 |
| 5,982,091 A | * | 11/1999 | Konishi | 313/495 |

* cited by examiner

*Primary Examiner*—Wilson Lee
*Assistant Examiner*—Ephrem Alemu
(74) *Attorney, Agent, or Firm*—Thelen Reid & Priest, LLP

(57) ABSTRACT

A device produces an electric field between two electrodes, the electric field having a specified value in the vicinity of a first of the two electrodes. The device includes a means for applying a potential difference between the two electrodes, means forming modulation electrode located near to the first electrode in the vicinity of which the electric field must have specified value. The device also includes control means for applying a potential difference between the means forming modulation electrode and the first electrode located nearby in order to obtain, through the contribution of the potential differences, the specified value of electric field.

35 Claims, 7 Drawing Sheets

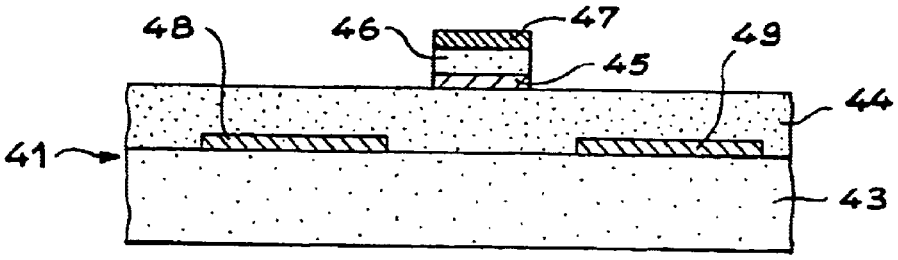
FIG. 5
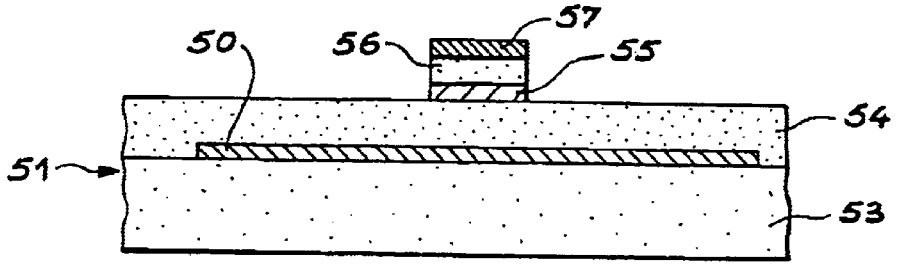
FIG. 6
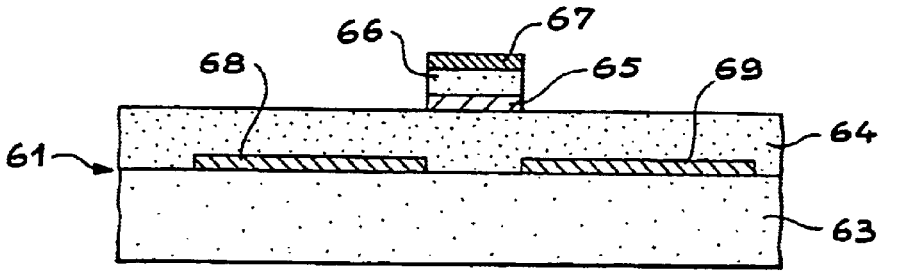
FIG. 7
FIG.8
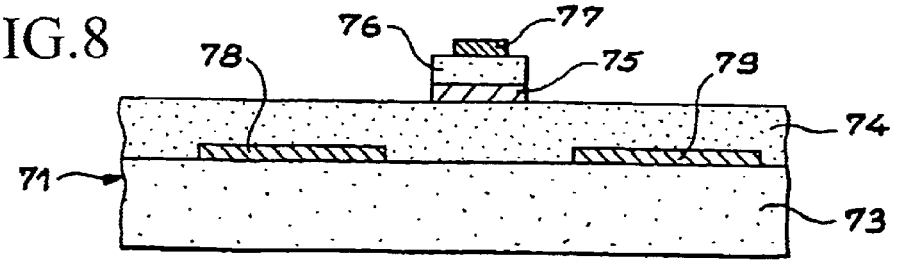

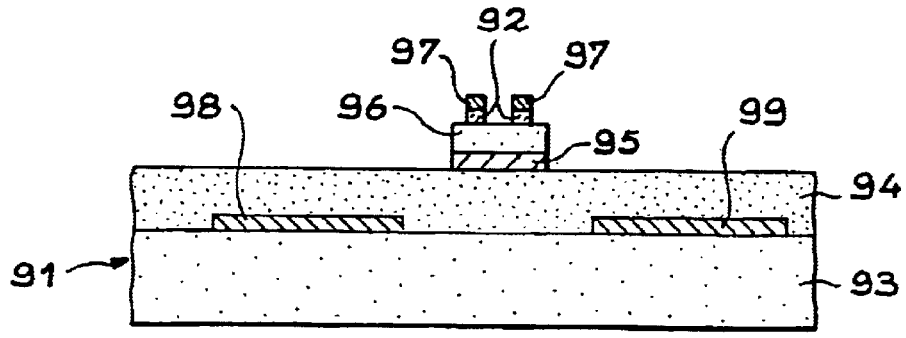
FIG. 9
FIG.11
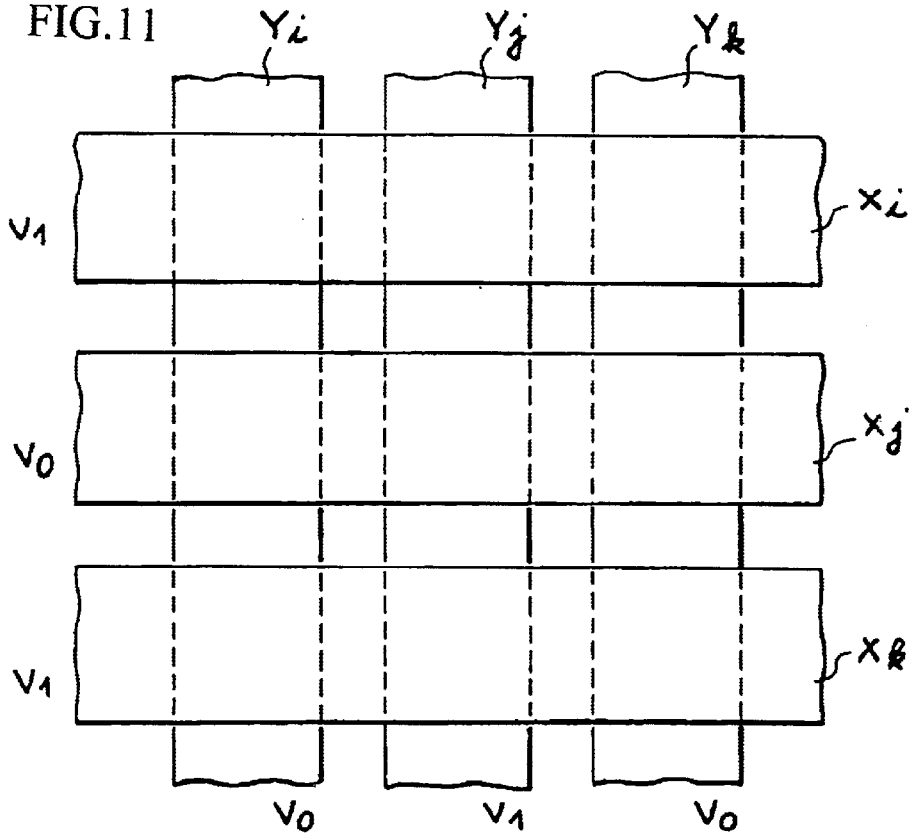

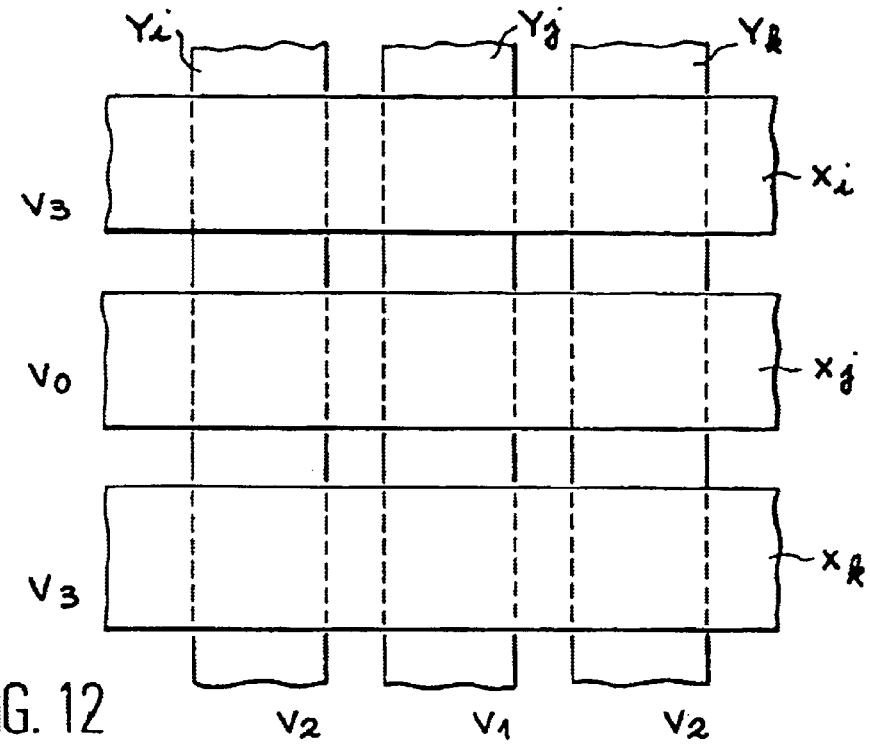
FIG. 12
FIG.13
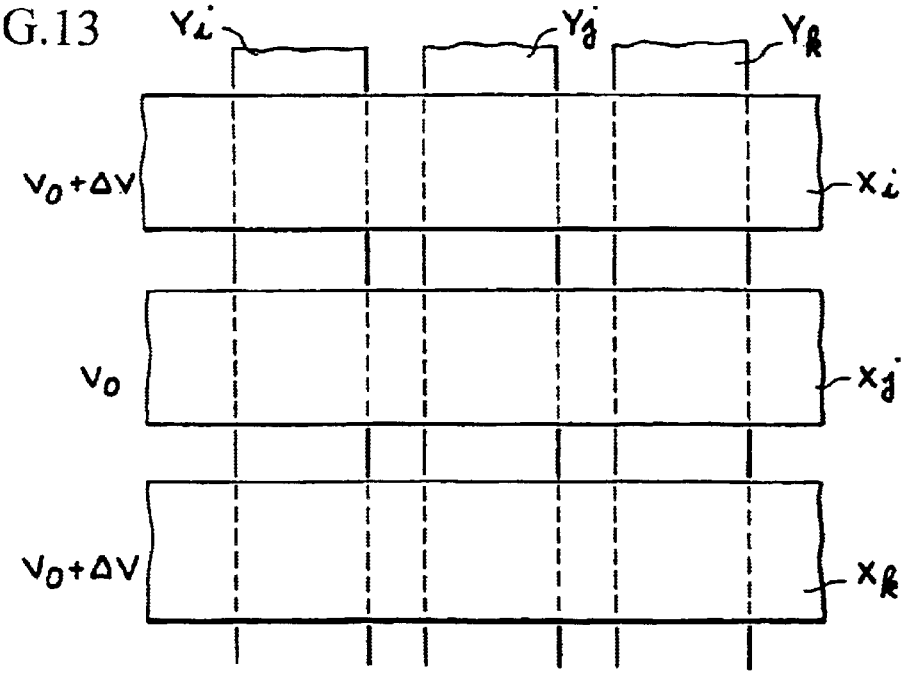

FIELD EMISSION FLAT SCREEN WITH MODULATING ELECTRODE

This application is a phase of PCT/FR00/02487 which was filed on Sep. 8, 2000, and was not published in English.

TECHNICAL FIELD

The present invention concerns a device to produce a modulated electric field for an electrode. This applies in particular to flat field emission screens.

STATE OF THE ART

The devices for visualization by cathodoluminescence excited by field emission are well known. Such a device comprises a cathode arranged facing an anode. The cathode is a flat structure emitting electrons and the anode is another flat structure covered with a luminescent film. These structures are separated by a space in which a vacuum is created.

The cathode can be a source of microtips or a source with a low threshold field emissive material (the threshold field being the electric field needed to extract electrons from a material), for example nanostructures or carbon. The sources with an emissive material used in screen devices are usually shown in two forms—a diode type structure or a triode type structure.

FIG. 1 shows in a transversal cross-section view, a flat field emission screen operating according to a diode type structure. The cathode 1 is made up of a plate of insulating material 3 supporting parallel metallic tracks 4 and covered with layers of an emissive material 5. The anode 2 is an insulating and transparent plate 6, for example in glass, supporting parallel conductor tracks 7 and at right angles to the cathode tracks 4. The tracks 7 are made by the etching of a layer of a transparent conducting material such as tin and indium mixed oxide (ITO). The tracks 7 are covered with films of phosphor 8.

The cathode plate and anode plate are placed facing one another, the tracks being opposite to make up a matrix structure. The crossing of the track networks forms image elements or pixels. By applying an adequate potential difference between one track 4 of the cathode and one track 7 of the anode, an emission of electrons occurs on the zone of the track 4 corresponding to the considered pixel, and the zone of the phosphor 8 facing is excited. A complete image can be obtained on the screen by successively supplying each line of the screen and by sweeping.

So that electrode emission occurs, an emissive material with low threshold field such as carbon needs a minimum electric field of several V/$\mu$m between an anode track and a facing cathode track. If the space between these tracks is 1 mm, a potential difference of several kV must therefore be applied, usually between 5,000 and 10,000 V. This leads to two main problems. The first is the resistance in voltage—there is danger of breakdown between anode and cathode and above all between two adjacent tracks. The second problem results from the need to switch a voltage of several kV when sweeping the screen. This problem can be resolved by reducing the space between anode and cathode which facilitates reducing in the same way the potential difference between them while maintaining the same electric field. The disadvantage of this solution is that this decrease in potential causes a decrease in the output of the phosphors and less brilliance in the screen.

The triode type structure has been suggested in order to try and remedy these problems. FIG. 2 shows in transversal cross-section a flat field emission screen implementing such a structure. The cathode 11 is made up of a glass plate 13 supporting parallel metallic tracks 14 and covered with layers 15 of an emissive material, carbon for example.

The tracks 14 are placed on the bottom of trenches etched in a layer of insulating material 10, the layer 10 being covered with a metal layer 19 serving as extracting gate. The anode 12 can be made up of a transparent plate 16 with for example a transparent and conductive film 17 covered by a film of luminescent material 18.

An emission of electrons by the emissive material can be obtained by applying, between the extraction gate 19 and track 14, a potential difference so that the resulting electric field on the emissive material is greater than the threshold field of this material, usually several V/$\mu$m. As the distance separating the extraction gate from the tracks is very much smaller than the distance separating the anode from the cathode, the potential difference to be applied is reduced in the same way.

As the lines of electric field go from tracks 14 to the extraction gate 19, a large part of the electrons emitted is going to be trapped by the gate. The triode type structure therefore has the disadvantage resulting from the fact that very few of the electrons emitted reach the phosphor layer.

Such a visualization device of triode type structure therefore enables avoiding the risk of electric breakdown and the problems of high voltage switching. However, these improvements are obtained to the detriment of electron density emitted which reach the luminophore or phospor layer. Moreover, this type of structure needs the realization of a deposit of emissive material solely on the bottom of trenches which presents considerable difficulties.

SUMMARY OF THE INVENTION

The present invention provides for solving the problems set forth above. The solution consists in applying a modulation electric field near to an electrode in the vicinity of which one wishes to obtain an electric field of specified value. Depending on the case, the modulation electric field will have the effect of decreasing or increasing the value of the electric field in the vicinity of the electrode in question.

The first object of the invention concerns a device which permits producing an electric field between a first and a second electrode, comprising:

- means for applying a potential difference between these two electrodes, allowing to obtain, if this potential difference is applied alone, a predetermined value of electric field in the vicinity of the first electrode,
- means forming modulation electrode located near the first electrode, either on the same plane or so that the first electrode is inserted between the second electrode and said means forming modulation electrode,
- control means for applying a potential difference between the means forming modulation electrode and the first electrode in order to obtain through the contribution of said potential differences another predetermined value of electric field in said vicinity of the first electrode.

In a first case, the means for applying a potential difference between the first and the second electrode and the control means, supply potential differences such that the value of the electric field in said vicinity of the first electrode is greater than the value which would be due to the potential difference alone between the first and the second electrode.

In a second case, the means for applying a potential difference between the first and the second electrode and the control means, supply potential differences so that the value of the electric field in said vicinity of the first electrode is lower than the value which would be due to the potential difference alone between the first and the second electrode.

Conveniently, the first and the second electrode and the means forming modulation electrode are arranged parallel.

The means forming modulation electrode can comprise two electrodes surrounding the first electrode.

If the first electrode is inserted between the second electrode and the means forming modulation electrode, the means forming modulation electrode can be made up by a single electrode.

The second object of the invention concerns a process for producing an electric field between a first and a second electrode comprising:

the application of a potential difference between the first and the second electrode so as to obtain, if this potential difference was applied alone, a predetermined value of the electric field in the vicinity of the first electrode, the application of a potential difference between the first electrode and means forming modulation electrode and located near to the first electrode, either in the same plane or so that the first electrode is inserted between the second electrode and said means forming modulation electrode, in order to obtain in association with the electric field due to the application of the potential difference between the first the second electrode, another predetermined value of electric field.

In a first case, the application of the potential difference between the first and the second electrode is such that if this potential difference was applied alone, the electric field in said vicinity of the first electrode would be greater than said other predetermined value.

In a second case, the application of the potential difference between the first and the second electrode is such that if this potential difference was applied alone, the electric field in said vicinity of the first electrode would be lower than said other predetermined value.

A third object of the invention concerns a field emission screen comprising an anode plate and a cathode plate facing one another, the anode plate comprising on its internal surface of the screen at least one electrode supporting phosphor means, the cathode plate comprising on its internal surface of the screen at least one electrode emitting electrons at least partially facing the anode electrode, this cathode electrode becoming emitter of electrons when the electric field in its vicinity exceeds a threshold value, the screen also comprising application means for a potential difference between said anode electrode and said cathode electrode, characterized in that the screen further comprises means forming modulation electrode located in the vicinity of the cathode electrode, either on the same plane or so that the cathode electrode is inserted between the anode electrode and said means forming modulation electrode, the screen also comprising control means for applying a potential difference between the cathode electrode and the means forming modulation electrode, the means for applying potential differences is such it provides for obtaining in said vicinity of the cathode electrode a predetermined value of electric field resulting from the contribution of said potential differences, said predetermined value being as one wishes either lower than said threshold value, or greater than said threshold value.

In a first case, the means for applying a potential difference between said anode electrode and said cathode electrode is such that, in the absence of a potential difference applied between the cathode electrode and the means forming modulation electrode, said predetermined value of electric field is lower than said threshold value.

In a second case, the mains for applying a potential difference between said anode electrode and said cathode electrode is such that, in the absence of a potential difference applied between the cathode electrode and the means forming modulation electrode, said predetermined value of electric field is greater than said threshold value.

The means forming modulation electrode can comprise two electrodes surrounding the cathode electrode.

If the cathode electrode is located between the anode electrode and the means forming modulation electrode, the means forming modulation electrode can be made up of a single electrode.

Advantageously, the cathode electrode and the means forming modulation electrode are separated by a layer of insulating material.

Preferably, the cathode electrode comprises a conductive part on which is deposited a layer of emissive material. This layer of emissive material can be separated from the conductive part by a resistive film. The layer of emissive material need only cover part of the resistive film. The emissive material can be a material deposited on the resistive film by a catalyst material deposited on the resistive film and on which the emissive material settles preferentially.

The display screen is conveniently of the matrix type, the crossing of lines and columns defining pixels.

According to a preferred arrangement, the anode plate comprises a common electrode with phosphor means, the cathode plate comprises a plate supporting conductor lines constituting the means forming modulation electrode, covered with a layer of dielectric material, the layer of dielectric material supporting the conductive columns, the lines and columns forming a matrix arrangement connected to addressing means and defining pixels, the conductive columns having an emissive material. Each pixel can correspond to the crossing of a line and several column conductors.

According to a specific arrangement, the conductive lines comprise windows facing the conductor columns, the emissive material supported by the conductor columns being only present on the areas of the conductor columns corresponding to the windows.

A fourth object of the invention concerns a process for the use of a field emission screen comprising at least one anode electrode and at least one cathode electrode facing, the cathode electrode comprising an emissive material emitting electrons when the electric field in the vicinity of the cathode electrode exceeds a threshold value, characterized in that, in order to obtain an emission of electrons on the part of the emissive material, it comprises:

the application of a potential difference between the anode electrode and the cathode electrode so as to obtain in the vicinity of the cathode electrode, if this potential difference was applied alone, an electric field of value lower than said threshold value, the application of a potential difference between the cathode electrode and the means forming modulation electrode located near the cathode electrode, either in the same plane or so that the cathode electrode is inserted between the anode electrode and said means forming modulation electrode, so as to obtain in said vicinity of the cathode electrode, in association with the electric field due to the application of the potential difference between the anode and cathode electrodes, an electric field value greater than said threshold value.

A fifth object of the invention concerns a process for the use of a field emission display screen comprising at least one anode electrode and at least one cathode electrode facing, the cathode electrode comprising an emissive material emitting electrons when the electric field in the vicinity of the cathode electrode exceeds a threshold value, characterized in that, in order to avoid an emission of electrons from the emissive material, it comprises:

the application of a potential difference between the anode electrode and the cathode electrode so as to obtain in the vicinity of the cathode electrode, if this potential difference was applied alone, an electric field greater in value than said threshold value, the application of a potential difference between the cathode electrode and the means forming modulation electrode located in the vicinity of the cathode electrode, either in the same plane or so that the cathode electrode is inserted between the anode electrode and said means forming modulation electrode, so as to obtain in said vicinity of the cathode electrode, in association with the electric field due to the application of the potential difference between the anode and cathode electrodes, an electric field value lower than said threshold value.

BRIEF DESCRIPTION OF THE DRAWINGS

The invention will be better understood and other advantages and specificities will come to light on reading the following descriptions, given as non-restricting examples, accompanied by attached drawings among which:

FIGS. 5 to 9 show embodiments of realization of an element of flat field emission screen according to the invention;

FIGS. 11 to 13 are diagrams of voltages to be applied to address a pixel of screen according to the invention.

DETAILED DESCRIPTION OF REALIZATION MODES OF THE INVENTION

Figure 1:
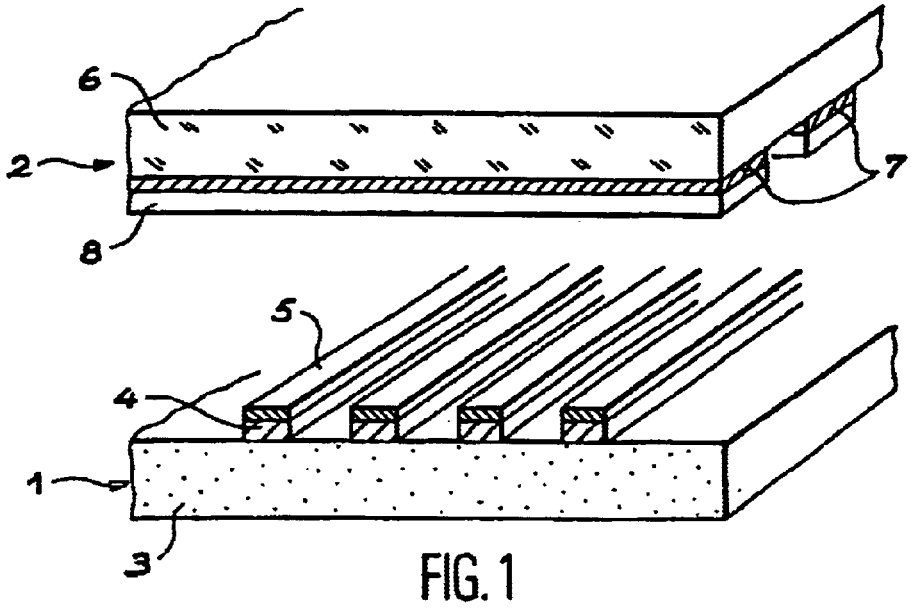
FIG. 1 (PRIOR ART)
FIG. 1, already described, is a perspective view, in transversal cross-section, of a flat field emission screen according to the prior art.
Figure 2:
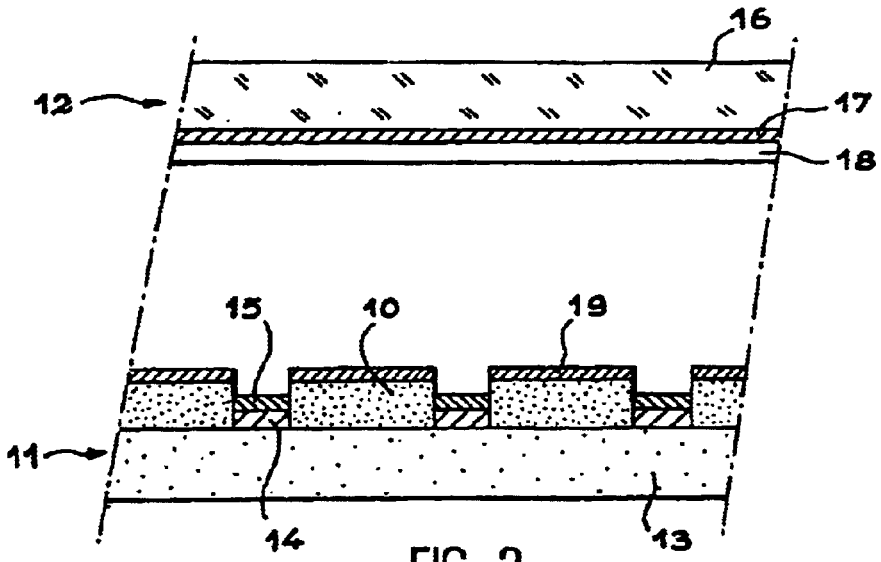
FIG. 2 (PRIOR ART)
FIG. 2, already described, is a transversal cross-section of a second flat field emission screen according to the prior art.
Figure 3A:
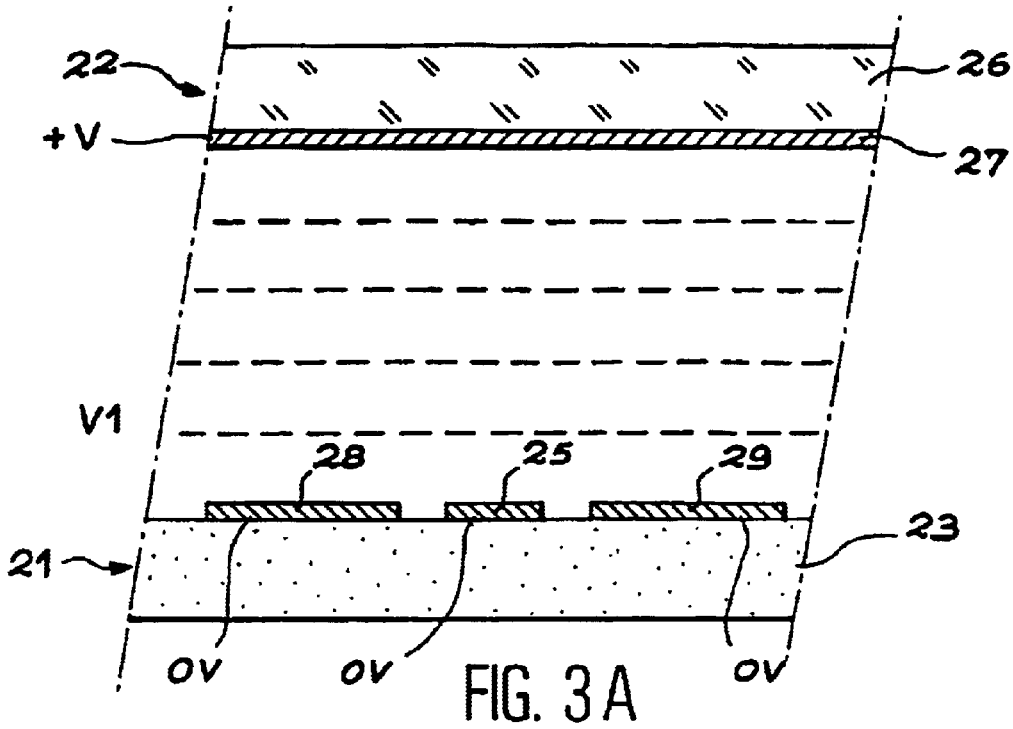
FIGS. 3A and 3B are cross-sections illustrating the operation of a device according to the invention.
Figure 3B:
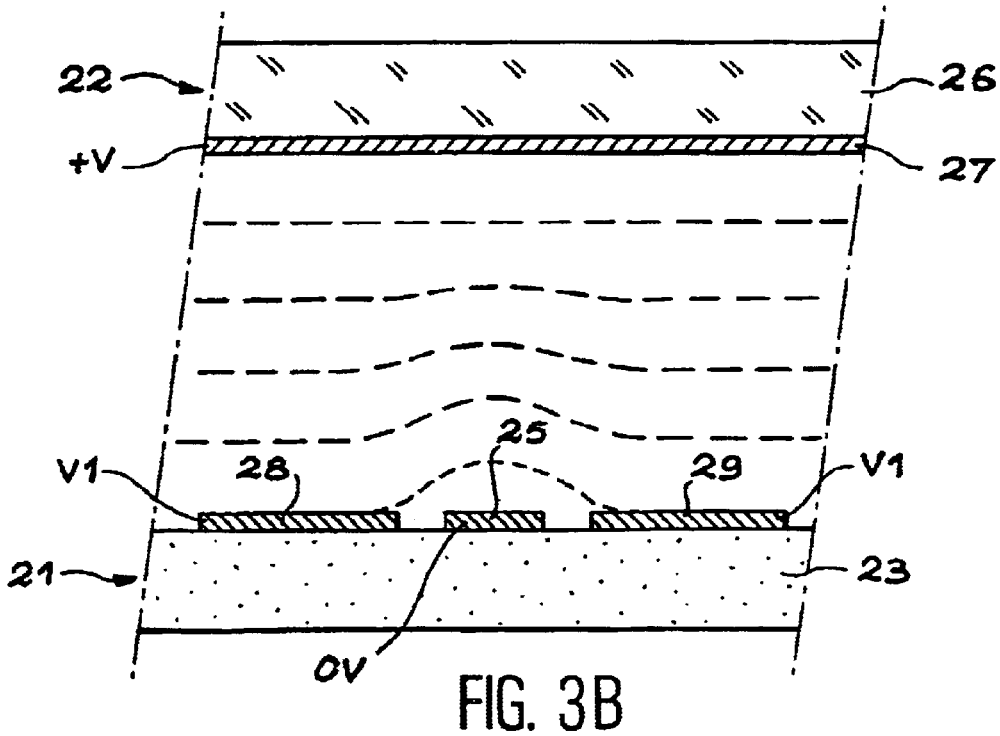

FIGS. 3A and 3B are cross-section views illustrating the workings of a device according to the invention. The device comprises a plate 21 designated in this example as cathode plate. The cathode plate 21 comprises a support plate 23 supporting an electrode 25 surrounded by two parts 28 and 29 of a same electrode. The device also comprises a plate 22 designated in this example as anode plate. The anode plate 22 comprises a support plate 26 supporting an electrode 27. The anode plate and cathode plate are arranged facing one another and parallel, their corresponding electrodes facing each other. They are separated by the distance d.

FIG. 3A shows the case when a potential +V is applied on the electrode 27 and a zero potential on electrode 25 as well as on the parts 28 and 29. A uniform electric field of value V/d is established within the device. Equipotential lines are shown by broken lines on FIG. 3A. The line represented nearest to the electrode 25 corresponds to the potential $V_1$, intermediate between the potential of the cathode electrode 25 and that of the anode electrode 27.

FIG. 3B shows the case when a potential +V is applied on the electrode 27, a zero potential on electrode 25 and a potential $V_1$ on the parts 28 and 29. There then occurs a shift and deformation of the equipotentials which cause a narrowing of the equipotentials above the cathode electrode 25, therefore an increase of the electric field at this point. The same effect is obtained if a potential difference is fixed between the electrode 27 and the parts 28 and 29 and the electrode 25 is taken to a more negative potential than that of the parts 28 and 29 as compared with the electrode 27.

Inversely, if one wishes to decrease the value of the existing electric field on the electrode 25 by an imposed potential difference between the electrodes 25 (the potential +V) and 27 (a zero potential), the parts 28 and 29 can be brought to the potential$-V_1$.

The electrode made up of the parts 28 and 29 can therefore be designated under the term modulation electrode.

Figure 4:
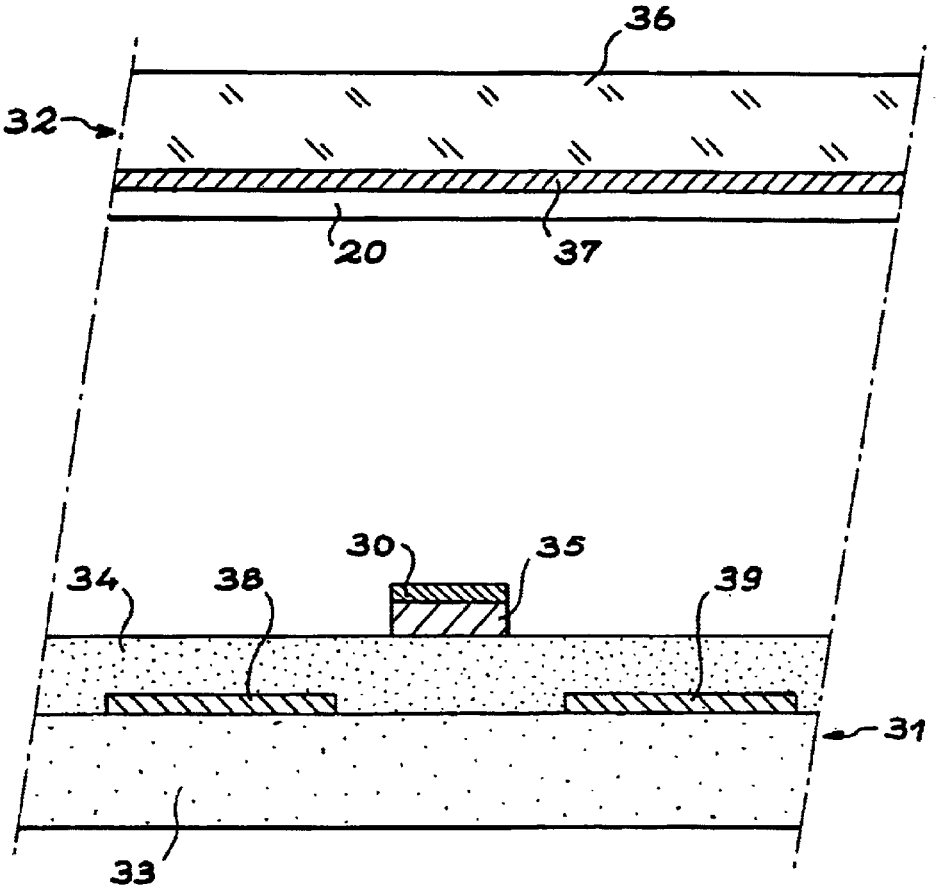
FIG. 4 is a transversal cross-section and partial view of a flat field emission screen according to the invention.

FIG. 4 is a partial view, in transversal cross-section, of a flat field emission screen to which the control mode according to the invention is applied. This screen comprises a cathode plate 31 and an anode plate 32 placed facing one another and parallel. They have electrodes on their inside face. Spacers, not shown, provide constant spacing between the cathode plate and anode plate and a vacuum is created inside the screen.

The cathode plate 31 comprises a support plate 33 in insulating material, for example glass, on which a network of metal strips 38, 39 are placed successively to make up the modulation electrodes, an insulating film 34 (for example silica) then a network of cathode electrodes 35 placed in the intervals of the underlying circuit. On FIG. 4, a single electrode of the cathode has been shown. It is either made up of a material with low threshold field, or covered by a layer of material with low output work, for example carbon or nanostructures. On FIG. 4 the cathode electrode 35 has a layer 30 of such a material. The strips 38 and 39 corresponding to an electrode 35 are connected together electrically to make up a modulation electrode.

The anode plate 32 comprises a support plate 36 in insulating material and transparent—usually glass—covered successively with a film 37 of transparent and conductive material, for example ITO, and a film 20 of luminescent material.

The screen can be used according to the first operating mode as follows. Between the anode electrode 37 and the cathode electrode 35 a potential difference is applied such that the electric field resulting from the emitting electrode is lower than the extraction threshold field of electrons from the emissive material 30. There is therefore no emission of electrons under the effect of this single field.

If the modulation electrode 38, 39 is brought to an intermediate potential between that of the anode and that of the emitting electrode, a shift and deformation of equipotentials occurs causing an increase of the electric field on the emitting electrode. The potential of the modulation electrode can be chosen so that the electric field on the emitting electrode becomes greater than the threshold field of the emissive material. There will then be emission of electrons. These electrons are emitted at right angles to the emission electrode. They are then accelerated by the anode field and strike the luminescent film 20 covering the anode electrode 37. In this way, for any value V of the potential applied to the emissive electrode, there is a value $V_s$ of potential which, applied to the modulation electrode, makes it possible to have an electric field on the emitting electrode equal to the threshold field of emission of the material, $V_s$ being greater than V:

$$V_s=V+\Delta V_s$$

For any value of potential of the modulation electrode greater than $V_s$, there is emission of electrons.

As an example, the anode plate 32 and cathode plate 31 can be 1 mm apart, the metal strips 38 and 39 can have a width of 20 $\mu$m and be 10 $\mu$m apart. The insulating layer 34 can be a film of silica, 1 Mm thick. The cathode electrode 35 can have a width of 5 $\mu$m and be in the centre of the space separating the metal strips 38 and 39. For an emissive material 30 with a threshold field of 5 to 6 V/$\mu$m, which is usual, a potential of +3000 V is applied on the anode as compared to the cathode, which gives an electric field of 3 V/$\mu$m on the emitting electrode, this field being lower than the threshold field. As the cathode electrode 35 is being maintained at 0 V, if the modulation electrode 38, 39 is brought to +30 V, the electric field on the surface of the emissive electrode changes to 7 V/$\mu$m which is greater than the threshold field. It appears therefore that the voltages to be switched over remain low, usually several tens volts which does not cause any problems.

The screen can also be used according to the second operating mode as follows. Between the anode electrode 37 and the cathode electrode 35 a potential difference is applied and the result is an electric field on the emitting electrode. If this electric field is greater than the extraction threshold field of electrons from the emissive material 30, there is emission of electrons under the effect of this field alone. If the modulation electrode 38, 39 is brought to a lower potential than that of the cathode electrode 35, a shift and deformation of equipotentials occurs causing a decrease of the electric field on the emitting electrode. The potential of the modulation electrode can be chosen so that the electric field on the emitting electrode becomes lower than the threshold field of the emissive material and thus facilitates stopping the emission of electrons. In this way, for any value V of the potential applied to the emitting electrode, there is a value $V_s$ of potential which, applied to the modulation electrode, makes it possible to have an electric field on the emitting electrode equal to the threshold field of emission of the material, $V_s$ being lower than V:

$$V_s=V-\Delta V_s$$

For any value of potential of the modulation electrode greater than $V_s$, there is emission of electrons. For any value lower than $V_s$, emission is eliminated.

The cathode plate, and notably the distribution of electrodes can present different embodiments. FIGS. 5 to 9 show some of the embodiments possible. For reasons of clarity, only a single cathode electrode has been shown in these drawings.

FIG. 5 shows a cathode plate 41 comprising a plate 43 in insulating material (glass for example) supporting a circuit of modulation electrodes, each formed by two conductive strips 48 and 49 connected together. The plate 43 also has an insulating film 44, in silica for example. On the insulating film 44 cathode electrodes 45 are placed, in correspondence with the modulation electrodes 48, 49. Each cathode electrode is placed above the interval separating the corresponding conductive strips 48 and 49 and symmetrical with the latter. On these cathode electrodes 45 are placed successively a resistive film 46 and a layer of emissive material 47. The function of the resistive film 46 is to standardize the emission on the surface of the emissive electrode which is formed by the superposition of the elements 45, 46 and 47. In this way very strong random emissions are prevented which can lead to breakdowns occurring. This arrangement facilitates reducing the superposition of the cathode electrode and the modulation electrode and thereby reducing to the minimum the parasistic capacity which there is between them, which is considerable when the surface of the screen is important. Certain devices do not need this precaution against parasistic capacity. The shape of the modulation electrode can change from the one shown in FIG. 5 to the shape shown in FIG. 6 where it is only made up of a single strip. It can obviously take on all the intermediary shapes.

FIG. 6 shows a cathode plate comprising, as in FIG. 5, a support plate 53, an insulating film 54, a cathode electrode 55, a resistive film 56 and a layer of emissive material 57. On the other hand, the modulation electrode 50 is made up of a single conductive strip as the emitting electrode is centred on the modulation electrode.

FIG. 7 illustrates an intermediary form. Here is the structure of the cathode plate as shown in FIG. 5. The cathode plate 61 comprises a support plate 63, two conductive strips 68 and 69 forming the modulation electrode, the insulating film 64 supporting the emitting electrode made up by the cathode electrode 65, the resistive film 66 and the layer of emissive material 67. The emitting electrode has in this embodiment the same width as the gap separating the two conductive strips 68 and 69.

In FIG. 8, there is also the structure of the cathode plate as seen in FIG. 5. The cathode plate 71 comprises a support plate 73, two conductive strips 78 and 79 forming the modulation electrode, the insulating film 74 supporting the emitting electrode made up by the cathode electrode 75, the resistive film 76 and the layer of emissive material 77. In this embodiment, the layer of emissive material 77 only covers the central section of the resistive film 76. This layout enables obtaining a more condensed bundle of electrons by eliminating electrons which could be subjected to the edge effects of the cathode electrode 75. This layout can be combined with the other embodiments described previously.

On FIG. 9, there is still the structure of the cathode plate as shown in FIG. 5. The cathode plate 91 comprises a support plate 93, two conductive strips 98 and 99 forming the modulation electrode, the insulating film 94 supporting the emitting electrode comprising the cathode electrode 95 and the resistive film 96. In this embodiment, the emitting electrode also comprises studs 92 in catalyst material, for example nickel, iron, cobalt or an alloy of these metals, these studs being placed on the resistive film 96. The studs 92 have emissive material 97, for example carbon, which is laid preferably on the catalyst material to make up emissive sites.

Figure 10:
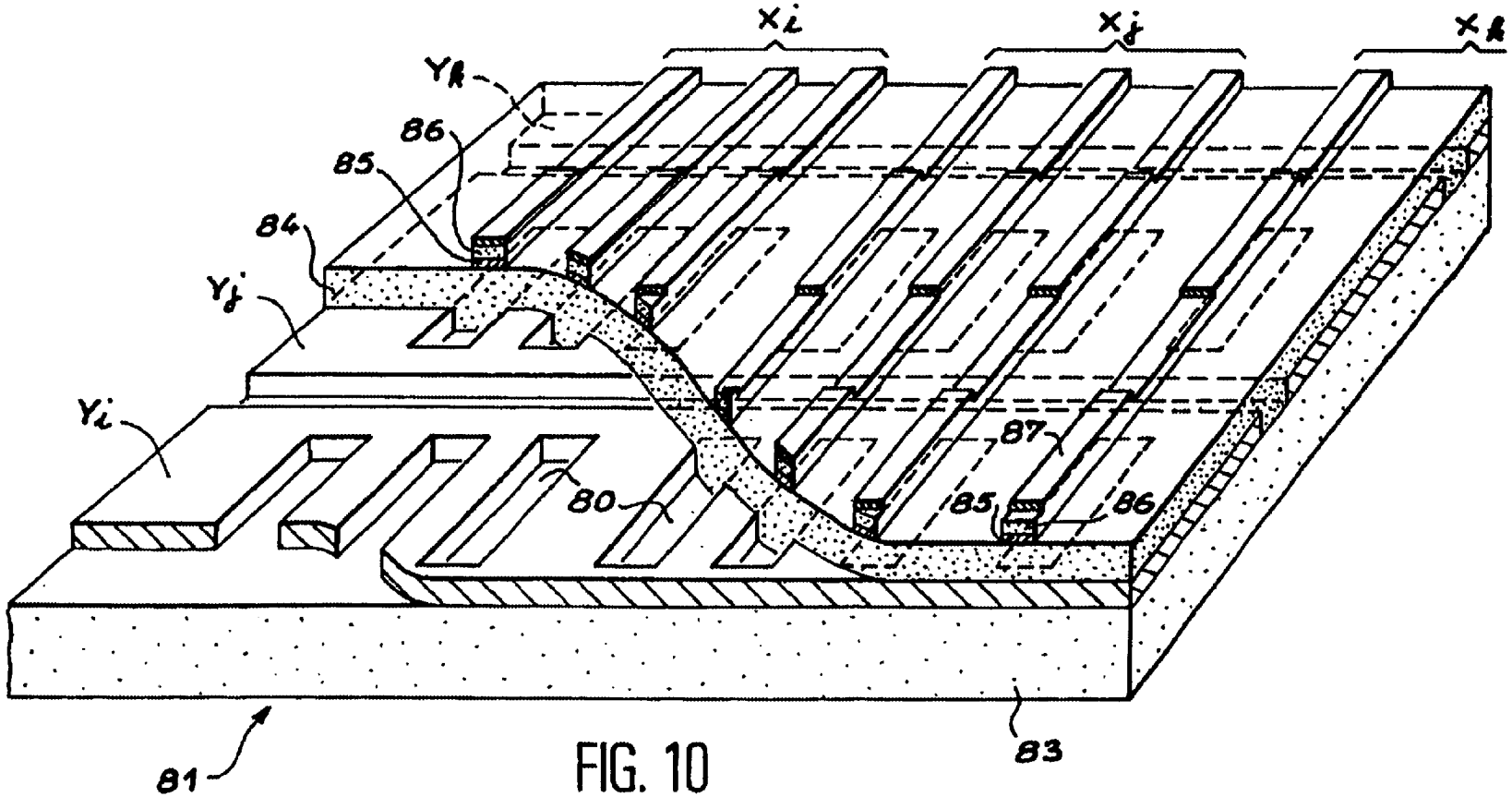
FIG. 10 is a perspective view of a cathode plate for flat field emission screen according to the invention.

FIG. 10 is a explosed and perspective view of a cathode plate for flat field emission screen of the matrix type implementing the invention. The cathode plate 81 comprises a plate 83, in glass for example, supporting a network of conductive strips Y forming lines, for example $Y_i$, $Y_j$, and $Y_k$. In these strips, openings or windows 80, for example rectangular, have been fashioned. This network of lines is covered by a layer of dielectric material 84 on which parallel conductive strips 85 have been laid and at right angles to the strips Y. The conductive strips 85 are, in this example of realization, grouped in threes to constitute the columns $X_i$, $X_j$, and $X_k$. The conductive strips 85 are each covered with a layer of resistive material 86 and emissive material. In the example in FIG. 10, the emissive material 87 has only been laid on the useful areas, i.e. on the areas of columns located above windows 80 made in the lines. In this way two networks are obtained, one of lines and the other of columns, mutually at right-angles. A pixel is constituted by the crossing of a line and a column.

FIG. 11 is an example of diagrams of the voltages to be applied in order to address a pixel of a screen comprising a cathode plate of the type shown in FIG. 10 and in the case when the voltage applied between the anode and the cathode creates an electric field lower than the emission threshold field. This example allows reducing to the minimum the number of voltage values necessary. To address the pixel $X_j$, $Y_j$ the anode, not shown, is brought up to a potential $V_A$, the column $X_j$ to the potential $V_0$ and the line $Y_j$ to a potential $V_1$ ($V_1$ being intermediary between $V_0$ and $V_A$). The other columns X are brought up to the potential V1 whilst the other lines Y are brought to the potential $V_0$. The potential $V_1$ is chosen so that the increase of the electric field on the emitting electrode is such that this electric field becomes greater than the threshold field.

FIG. 12 is a diagram of the voltages to be applied to address a pixel of a display screen comprising a cathode plate of the type shown in FIG. 10 and in the case when the voltage applied between the anode and the cathode creates an electric field higher than the emission threshold field. To address a pixel $X_j$, $Y_j$ the anode, not shown, is brought up to a potential $V_A$, and the column $X_j$ to the potential $V_0$. If one calls d the distance separating the anode from the cathode, the electric field resulting from this difference of potential $(V_A-V_0)/d$ is greater than the emission threshold field of the material. So that the pixel $X_j$, $Y_j$ emits, the potential $V_1$ of the line $Y_j$ must be greater than the voltage $V_s$. On the column $X_j$, in order for the pixels $X_j$, $Y_1$ and $X_j$, $Y_k$ be off, the potential $V_2$ of lines $Y_i$ and $Y_k$ must be lower than $V_s$. On the line $Y_j$, the two pixels $X_i$, $Y_j$ and $X_k$, $Y_j$ must be off. For this, the potential $V_3$ of columns $X_i$ and $X_k$ must be greater than $V_1+\Delta V_s$, $\Delta V_s$ being equal to $V_0-V_s$. The pixels $X_i$, $Y_i/X_i$, $Y_k/X_k$,$Y_i$ and $X_k$, $Y_k$ have a column voltage equal to $V_3$ and a line voltage equal to $V_2$. In fact, $V_2<V_5$, $V_3>V_1+\Delta V_s$, $V_1>V_s$ and $V_3>V_s+\Delta V_s$. The difference between the voltages of columns $X_i-X_k$ and the lines $Y_i-Y_k$ being higher than $\Delta V_s$ and the line voltages being lower than the column voltages, the corresponding pixels do not emit.

FIG. 13 is also a voltage diagram applicable to the preceding case. Among all the values possible for $V_1$, $V_2$ and $V_3$, an easier solution can be chosen. Thus, given that $V_1=V_0$ and $\Delta V>\Delta V_s$ in order to address a pixel $X_j$, $Y_j$ a voltage $V_0$ must be applied on the column $X_j$ and the line $Y_j$, the other columns being brought up to a voltage $V_0+\Delta V$ and the other lines to a voltage $V_0-\Delta V$.

What is claimed is:

1. A Device for producing an electric field between a first electrode and a second electrode, comprising:

means for applying a potential difference between these two electrodes, allowing to obtain, if this potential difference is applied alone, a predetermined value of electric field in a vicinity of the first electrode, means for forming modulation electrode located near to the first electrode so that the first electrode substantially totally occupies the space situated between the second electrode and the portion of said means forming modulation electrode that is the most distant from the second electrode, control means for applying a potential difference between the means for forming modulation electrode and the first electrode in order to obtain through the contribution of said potential differences another predetermined value of electric field in said vicinity of the first electrode.

2. A Device according to claim 1, characterized in that the means for applying a potential difference between the first and the second electrode, and the control means each supply potential differences such that the value of the electric field in said vicinity of the first electrode is greater than the value which it would be due to the potential difference alone between the first and the second electrode.

3. A Device according to claim 1, characterized in that the means for applying a potential difference between the first and the second electrode, and the control means each supply potential differences so that the value of the electric field in said vicinity of the first electrode is lower than the value which it would be due to the potential difference alone between the first and the second electrode.

4. A device according to claim 1, characterized in that the first and the second electrode and the means forming modulation electrode are arranged in parallel.

5. Device according to claim 1, characterized in that the means forming modulation electrode comprise two electrodes surrounding the first electrode.

6. A device according to claim 1 characterized in that when the first electrode is inserted between the second electrode and the means forming modulation electrode, the means forming modulation electrode is made up of a single electrode.

7. A Process for producing an electric field between a first electrode and a second electrode, comprising:

applying a potential difference between the first and the second electrode so as to obtain, if this potential difference was applied alone, a predetermined value of electric field in the vicinity of the first electrode, and applying a potential difference between the first electrode and means forming modulation electrode and located near to the first electrode, so that the first electrode substantially totally occupies the space situated between the second electrode and the portion of said means forming modulation electrode that is the most distant from the second electrode, in order to obtain in association with the electric field due to the application of the potential difference between the first and the second electrode, another predetermined value of electric field.

8. The process according to claim 7, characterized in that the application of the potential difference between the first and the second electrode is such that, if this potential difference was applied alone, the electric field in said vicinity of the first electrode would be greater than said other predetermined value.

9. The process according to claim 7, characterized in that the application of the potential difference between the first and the second electrode is such that, if this potential difference was applied alone, the electric field in said vicinity of the first electrode would be lower than said other predetermined value.

10. A field emission screen comprising:

an anode plate comprising, on its internal surface of the screen, at least one electrode supporting phosphor means, a cathode plate facing the anode plate and comprising on its internal surface of the screen at least one electrode emitting electrons at least partially facing the anode electrode, the cathode electrode becoming an emitter of electrons when the electric field in its vicinity exceeds a threshold value, application means for a potential difference between said anode electrode and said cathode electrode, characterized in that the screen further comprises:

means forming modulation electrode located in the vicinity of the cathode electrode, so that the cathode electrode substantially totally occupies the space situated between the anode electrode and the portion of said means forming modulation electrode that is the most distant from the anode electrode; and control means for applying a potential difference between the cathode electrode and the means forming modulation electrode, the means for applying potential differences is such that it provides for obtaining in said vicinity of the cathode electrode a predetermined value of electric field resulting from the contribution of said potential differences, said predetermined value being either lower than said threshold value, or greater than said threshold value.

11. The screen according to claim 10, characterized in that the means for applying a potential difference between said anode electrode and said cathode electrode is such that, in the absence of a potential difference applied between the cathode electrode and the means forming modulation electrode, said predetermined value of electric field is lower than said threshold value.

12. The screen according to claim 10, characterized in that the means for applying potential difference between said anode electrode and said cathode electrode is such that, in the absence of potential difference applied between the cathode electrode and the means forming modulation electrode, said predetermined value of electric field is greater than said threshold value.

13. The screen according to claim 10, characterized in that the means forming modulation electrode comprises two electrodes surrounding said cathode electrode.

14. The screen according to claim 10, characterized in that, as said cathode electrode is located between said anode electrode and the means forming modulation electrode, the means forming modulation electrode is made up of a single electrode.

15. The screen according to claim 10, characterized in that, as said cathode electrode is located between said anode electrode and the means forming modulation electrode, said cathode electrode and the means forming modulation electrode are separated by a layer of insulating material.

16. The screen according to claim 10, characterized in that as said cathode electrode comprises a conductor element on which is deposited a layer of emissive material.

17. The screen according to claim 16, characterized in that the layer of emissive material is separated from said conductor element by a resistive film.

18. The screen according to claim 17, characterized in that the layer of emissive material only covers part of the resistive film.

19. The screen according to claim 17, characterized in that the emissive material is a material deposited on the resistive film by means of a catalyst material deposited on the resistive film and on which the emissive material settles preferentially.

20. The screen according to claim 10, characterized in that it is of the matrix type having lines and columns, the crossing of lines and columns defining pixels.

21. The screen according to claim 10, characterized in that the anode plate comprises a common electrode with phosphor means, the cathode plate comprises a plate with conductor lines ($Y_i$, $Y_j$, $Y_k$) constituting the means forming modulation electrode, covered with a layer of dielectric material, the layer of dielectric material supporting conductor columns, the lines and columns forming a matrix arrangement connected to addressing means and defining pixels, the conductor columns having an emissive material.

22. The screen according to claim 21, characterized in that each pixel corresponds to the crossing of a line ($Y_i$, $Y_j$, $Y_k$) and several conductor columns.

23. The screen according to claim 21, characterized in that the conductor lines ($Y_i$, $Y_j$, $Y_k$) comprise windows facing the conductor columns, the emissive material supported by the conductor columns being only present on the areas of the conductor columns corresponding to the windows.

24. A process for the use of a field emission display screen comprising at least one anode electrode and at least one cathode electrode facing one another, the cathode electrode comprising an emissive material emitting electrons when the electric field in the vicinity of the cathode electrode exceeds at threshold value, characterized in that, in order to obtain an emission of electrons from the emissive material, it comprises:

applying a potential difference between the anode electrode and the cathode electrode so as to obtain in the vicinity of the cathode electrode, if this potential difference was applied alone, an electric field of lower value than said threshold value, and applying a potential difference between the cathode electrode and the means forming modulation electrode located near the cathode electrode, so that the cathode electrode substantially totally occupies the space situated between the anode electrode and the portion of said means forming modulation electrode that is the most distant from the anode electrode, so as to obtain in said vicinity of the cathode electrode, in association with the electric field due to the application of the potential difference between the anode and cathode electrodes, an electric field value greater than said threshold value.

25. A process for the use of a field emission display screen comprising at least one anode electrode and at least one cathode electrode facing one another, the cathode electrode comprising an emissive material emitting electrons when the electric field in the vicinity of the cathode electrode exceeds a threshold value, characterized in that, in order to avoid an emission of electrons from the emissive material, it comprises:

applying a potential difference between the anode electrode and the cathode electrode so as to obtain in the vicinity of the cathode electrode, if this potential difference was applied alone, an electric field of greater value than said threshold value, and applying a potential difference between the cathode electrode and means forming modulation electrode located in the vicinity of the cathode electrode, so that the cathode electrode substantially totally occupies the space situated between the anode electrode and the portion of said means forming modulation electrode that is the most distant from the anode electrode, in association with the electric field due to the application of the potential difference between the anode and cathode electrodes, an electric field value lower than said threshold value.

26. A device according to claim 3, characterized in that the first and the second electrode and the means forming modulation electrode are arranged in parallel.

27. A device according to claim 4, characterized in that the means forming modulation electrode comprise two electrodes surrounding the first electrode.

28. The screen according to claim 12, characterized in that the means forming modulation electrode comprises two electrodes surrounding said cathode electrode.

29. The screen according to claim 12, characterized in that, as said cathode electrode is located between said anode electrode and the means forming modulation electrode, the means forming modulation electrode is made up of a single electrode.

30. The screen according to claim 12, characterized in that, as said cathode electrode is located between said anode electrode and the means forming modulation electrode, said cathode electrode and the means forming modulation electrode are separated by a layer of insulating material.

31. The screen according to claim 15, characterized in that as said cathode electrode comprises a conductor element on which is deposited a layer of emissive material.

32. The screen according to claim 19, characterized in that it is of the matrix type having lines and columns, the crossing of lines and columns defining pixels.

33. The screen according to claim 22, characterized in that the conductor lines ($Y_i$, $Y_j$, $Y_k$) comprise windows facing the conductor columns, the emissive material supported by the conductor columns being only present on the areas of the conductor columns corresponding to the windows.

34. The device of claim 1, wherein the first electrode substantially completely occupies the space situated between the second electrode and the means forming modulation electrode.

35. The screen of claim 10, further comprising an insulating film, wherein the cathode electrode is separated from the means forming modulation electrode by at least the thickness of the insulating film.

* * * * *